US008994598B2

(12) United States Patent
Ogino et al.

(10) Patent No.: US 8,994,598 B2
(45) Date of Patent: Mar. 31, 2015

(54) CIRCULARLY POLARIZED WAVE RECEPTION ANTENNA

(75) Inventors: Kazushige Ogino, Kobe (JP); Yoshio Umezawa, Izumiotsu (JP)

(73) Assignee: Fujitsu Ten Limited, Hyogo (JP)

( * ) Notice: Subject to any disclaimer, the term of this patent is extended or adjusted under 35 U.S.C. 154(b) by 867 days.

(21) Appl. No.: 12/739,130

(22) PCT Filed: Oct. 21, 2008

(86) PCT No.: PCT/JP2008/069395

§ 371 (c)(1),
(2), (4) Date: Apr. 21, 2010

(87) PCT Pub. No.: WO2009/060735

PCT Pub. Date: May 14, 2009

(65) Prior Publication Data

US 2010/0231468 A1 Sep. 16, 2010

(30) Foreign Application Priority Data

Nov. 7, 2007 (JP) ..... 2007-290036

(51) Int. Cl.
*H01Q 1/32* (2006.01)
*H01Q 1/12* (2006.01)
*H01Q 7/00* (2006.01)

(52) U.S. Cl.
CPC ..... *H01Q 1/325* (2013.01); *H01Q 1/1271* (2013.01); *H01Q 7/00* (2013.01)
USPC ..... 343/713

(58) Field of Classification Search
USPC ..... 343/713
See application file for complete search history.

(56) References Cited

U.S. PATENT DOCUMENTS

| | | | | |
|---|---|---|---|---|
| 1,934,412 | A * | 11/1933 | Englund | 343/818 |
| 4,183,027 | A * | 1/1980 | Ehrenspeck | 343/726 |
| 6,624,794 | B1 * | 9/2003 | Wendt et al. | 343/864 |
| 2004/0021610 | A1 * | 2/2004 | Hickel | 343/713 |
| 2005/0052334 | A1 * | 3/2005 | Ogino et al. | 343/866 |

(Continued)

FOREIGN PATENT DOCUMENTS

| | | |
|---|---|---|
| JP | 4-78809 | 7/1992 |
| JP | 3431045 | 7/2003 |

(Continued)

OTHER PUBLICATIONS

English computer translation of JP 2007-288399 (Previously filed on Oct. 17, 2012), 11pp.

(Continued)

*Primary Examiner* — Graham Smith
(74) *Attorney, Agent, or Firm* — Christie, Parker & Hale, LLP.

(57) ABSTRACT

A GPS loop antenna attached to the front windshield of a vehicle to receive a circularly polarized wave which is improved in reception performance, that is, a loop antenna comprised of a loop-shaped antenna conductor receiving a circularly polarized wave, feed terminals connected to the two ends of the antenna conductor, and a parasitic element positioned near the antenna conductor and made of a conductor independent of the antenna conductor, all arranged on a sheet-like transparent film, wherein a looping line conductor is arranged around the loop antenna on the film. It is sufficient if the total length of the line conductor is about three times the antenna conductor.

19 Claims, 11 Drawing Sheets

(56) References Cited

U.S. PATENT DOCUMENTS

| | | | | |
|---|---|---|---|---|
| 2005/0179604 | A1* | 8/2005 | Liu et al. | 343/742 |
| 2005/0280598 | A1* | 12/2005 | Webb et al. | 343/867 |
| 2006/0220977 | A1* | 10/2006 | Ogino | 343/866 |

FOREIGN PATENT DOCUMENTS

| | | |
|---|---|---|
| JP | 2005-102183 | 4/2005 |
| JP | 2005-236656 | 9/2005 |
| JP | 2005-236659 | 9/2005 |
| JP | 2006-13696 | 1/2006 |
| JP | 2006-80999 | 3/2006 |
| JP | 2006-186488 | 7/2006 |
| JP | 2006-295545 | 10/2006 |
| JP | 2006-311497 | 11/2006 |
| JP | 2007-67543 | 3/2007 |
| JP | 2007-266999 | 10/2007 |
| JP | 2007-288399 | 11/2007 |

OTHER PUBLICATIONS

International Search Report, dated Dec. 2, 2008, corresonding to PCT/JP2008/069395.

Office action issued Jun. 12, 2012 in corresponding Japanese Patent Application No. 2007-290036, 5pp.

Japanese Office action issued in corresponding JP 2007-290036, mailing date Aug. 21, 2012, including English translation, 4pp.

* cited by examiner

CIRCULARLY POLARIZED WAVE RECEPTION ANTENNA

CROSS-REFERENCE TO RELATED APPLICATION

This application is a National Phase Patent Application and claims the priority of International Application Number PCT/JP2008/069395, filed on Oct. 21, 2008, which claims priority of Japanese Patent Application Number 2007-290036, filed on Nov. 7, 2007.

TECHNICAL FIELD

The present invention relates to a circularly polarized wave reception antenna. The present invention particularly relates to an improvement of the gain of a loop antenna used attached to a dielectric body portion of an automobile or other vehicle and receiving circularly polarized waves.

BACKGROUND ART

In the past, automobiles and other vehicles have been equipped with antennas enabling the reception of radio waves even during movement. Generally, the radio waves received by a vehicle have for long years principally been the medium waves (MW) for AM radio and the very high frequency (VHF) or ultrahigh frequency (UHF) waves for FM radio or television.

However, in recent years, the types of antennas mounted at vehicles have been increasing. For example, antennas for global positioning systems (GPS) or antennas for receiving radio waves for digital terrestrial broadcasts have been increasingly becoming mainstream. Antennas receiving radio waves for digital terrestrial TV broadcasts hereinafter will be referred to as "DTV antennas".

Circularly polarized waves have been used for the GPS radio waves or terrestrial digital TV broadcast radio waves received by such antennas mounted on vehicles. Further, for conventional circularly polarized wave antennas, patch antennas have usually been used. However, such a patch antenna is contained inside an antenna case. The case is tall and therefore the appearance was bad. Therefore, recently, film antennas used attached to the windows of the vehicles have been used (for example, see Japanese Patent Publication (A) No. 2005-102183).

However, the film antennas disclosed in Japanese Patent Publication (A) No. 2005-102183 etc. were not sufficient in reception performance.

DISCLOSURE OF THE INVENTION

Therefore, the present invention has as its object to provide a circularly polarized wave reception antenna able to be increased in gain, able to be improved in reception performance, and able to provide sufficient performance even as a film antenna.

A circularly polarized wave reception antenna of the present invention for achieving this object comprises a loop antenna provided with two feed terminals, a parasitic element positioned near the loop antenna and comprised from a conductor independent of the antenna conductor of the loop antenna, and a conductor positioned so as to surround the vicinity of the loop antenna and parasitic element. This conductor can be made a looping line conductor.

According to the antenna of the present invention, there is provided an antenna with a simple structure and good reception performance able to send and/or receive circularly polarized waves.

BEST MODE FOR CARRYING OUT THE INVENTION

Below, drawings will be used to explain preferred embodiments of the present invention. The same component parts will be explained assigned the same reference notations. Note that, in general, an antenna both sends and receives radio waves. However, in the embodiments below, to facilitate understanding, only the case where the antenna receives radio waves will be explained. The explanation for the case where the antenna sends radio waves will be omitted. Needless to say, the transmission of radio waves from the antenna is included in the present invention however.

Figure 1A:
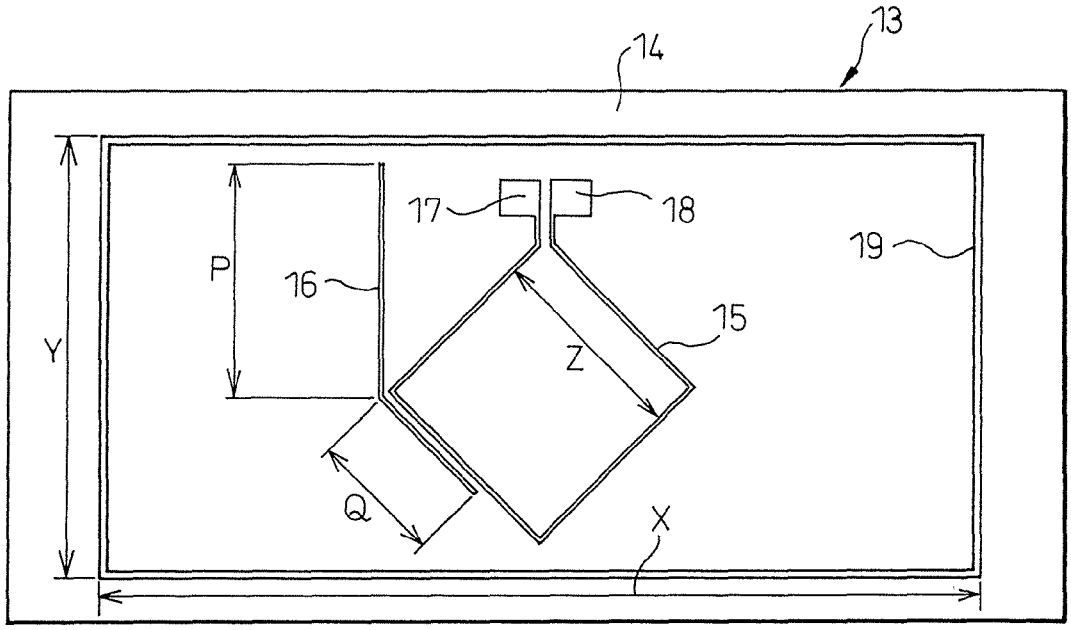
FIG. 1A is a plan view showing the structure of a circularly polarized wave reception antenna of a first embodiment of the present invention.

FIG. 1A shows the structure of a GPS antenna 13 of a first embodiment of the present invention. The GPS antenna 13 of this embodiment is a loop antenna comprised of a sheet-like transparent film 14 on which a rectangular antenna conductor 15 and a parasitic element 16 not electrically connected to the antenna conductor 15 are formed. The antenna 13 can receive a circularly polarized wave from a GPS satellite and can send a circularly polarized wave. On the other hand, there are feed terminals 17, 18 at the two ends of the antenna conductor 15. Later explained connectors are connected to these feed terminals 17 and 18. The antenna conductor 15, parasitic element 16, and feed terminals 17 and 18 are formed by conductive ink or copper foil or another conductor on the sheet-like transparent film 14.

The GPS antenna 13 of this embodiment has a rectangular looping line conductor 19 around the antenna conductor 15, parasitic element 16, and feed terminals 17, 18. The looping line conductor 19 is also formed by conductive ink or copper foil or another conductor on the sheet-like transparent film 14. The dimensions when arranging this GPS antenna 13 on a glass-like dielectric body are as follows for example. The length Z of one side of the rectangular antenna conductor 15 is 30 mm or so, the length of the distant part P of the parasitic element 16 is 40 mm or so, and the length of the parallel part Q is 20 mm or so.

Further, the length X of the looping line conductor 19 in the lateral direction can be made 90 mm or so, and the length Y of the looping line conductor 19 in the longitudinal direction can be made 90 mm or so. The total length of the looping line conductor 19 in this case is 180 mm or so. The aspect ratio can be changed according to the size of the loop antenna inside. Further, the optimum length of the looping line conductor 19 and the size of the GPS antenna 13 are determined by the dielectric constant of the dielectric body that the GPS antenna 13 is attached to.

Further, if setting the GPS antenna 13 on plastic foam, it is sufficient if the length Z of one side of the loop of the GPS antenna 13 is 50 mm or so, the length of the distant part P of the parasitic element 16 is 60 mm or so, and the length of the parallel part Q is 30 mm or so.

If arranging the rectangular looping line conductor 19 around the antenna conductor 15, parasitic element 16, and feed terminals 17, 18, making the total length (2X+2Y) of the looping line conductor 19 about three times (about 2.7 to 3.3 times) the total length (4Z) of the antenna conductor 15 will increase the gain of the GPS antenna 13. Further, the ratio (X:Y) of the length X of the lateral direction of the looping line conductor 19 to the length Y of the longitudinal direction is optimally 1:1, but there will be improved gain also with a range of 1:2 to 2:1.

Figure 1B:
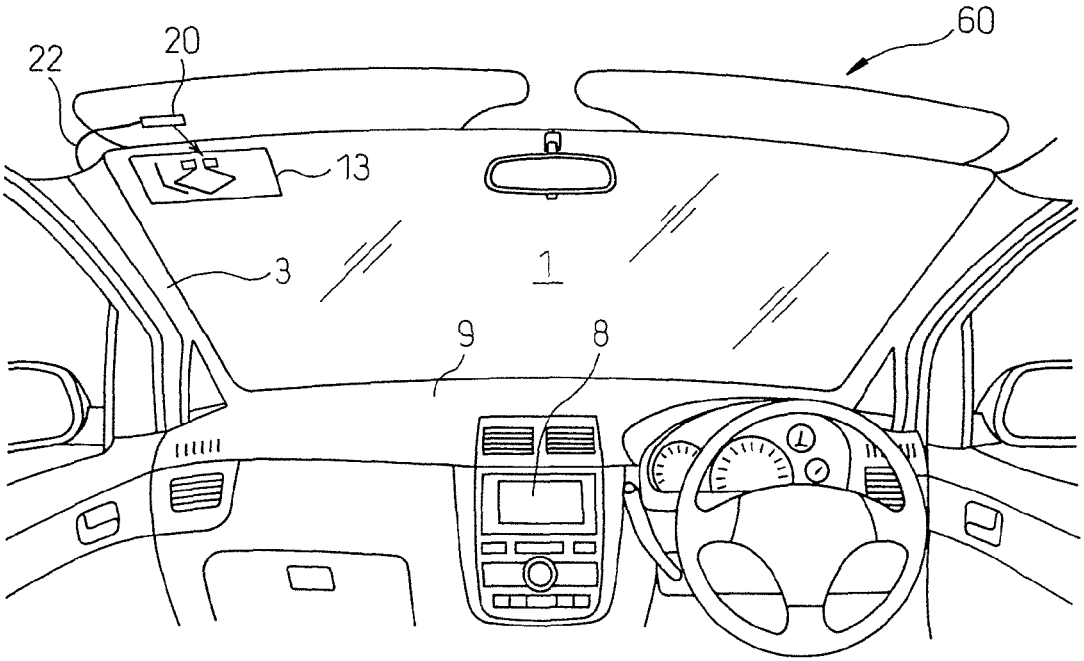
FIG. 1B is a perspective view showing an example of installation of the antenna shown in FIG. 1A at the front window of an automobile.

The GPS antenna 13 with the above such structure can be set near the top end of the front windshield 1 of the automobile 60 as shown in FIG. 1B for example. Depiction of the transparent film is omitted in this drawing. The GPS antenna 13 is connected to a feed circuit comprising a connector 20 and coaxial cable 22. The coaxial cable 22 is positioned along an A pillar 3 of the automobile 60 and is connected to a digital TV tuner not shown in the drawing. 8 is a car navigation system installed in an instrument panel 9 of the automobile. This receives an image signal from the tuner as input.

Figure 11:
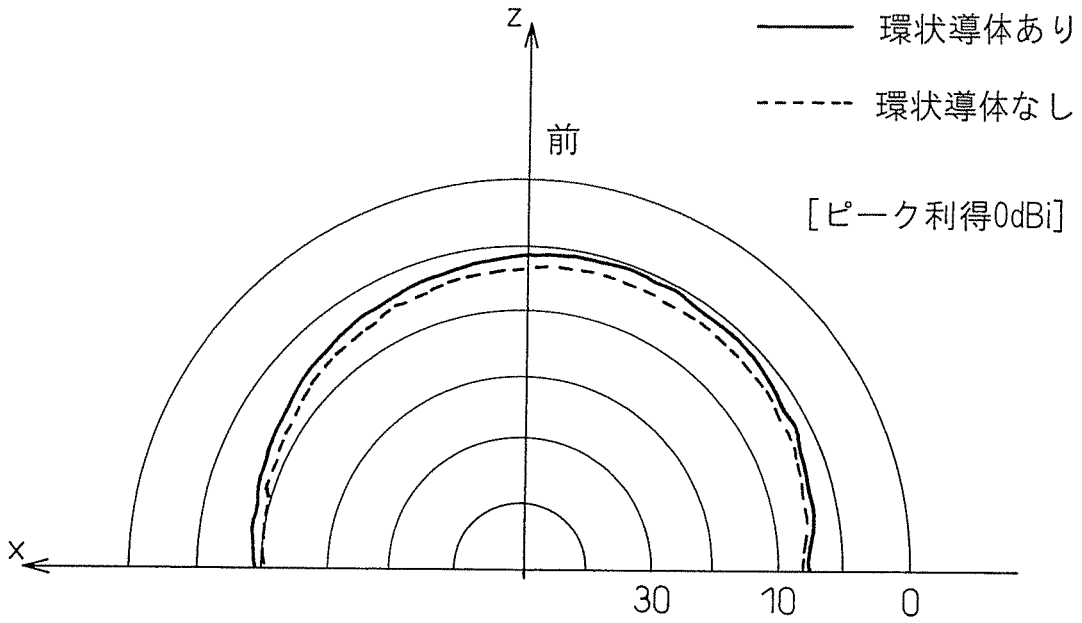
FIG. 11 is a directivity diagram comparing the gain when setting the antenna of the present invention near the top end of the front windshield of an automobile to when using a conventional antenna.
Figure 7:
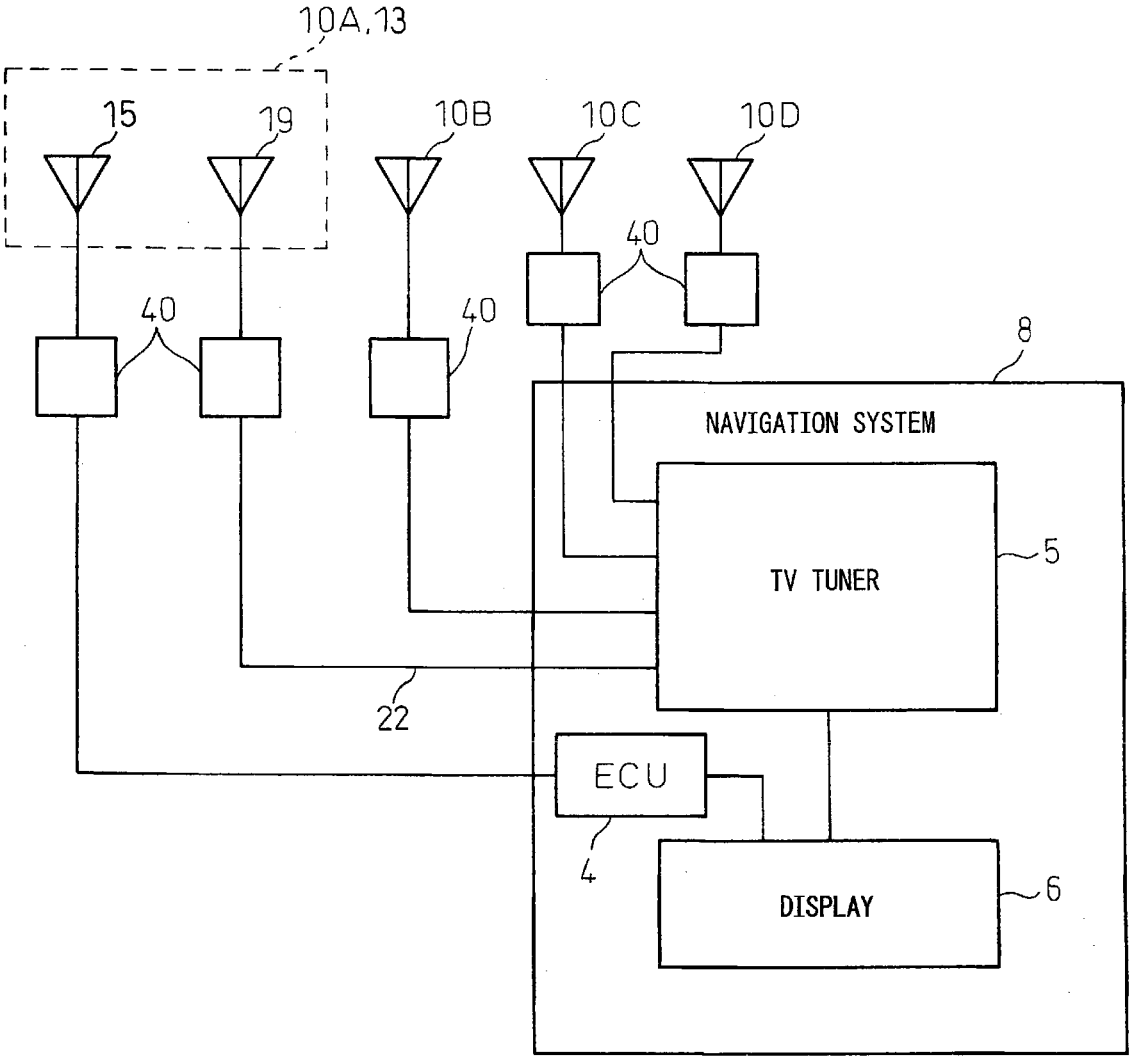
Figure 11:
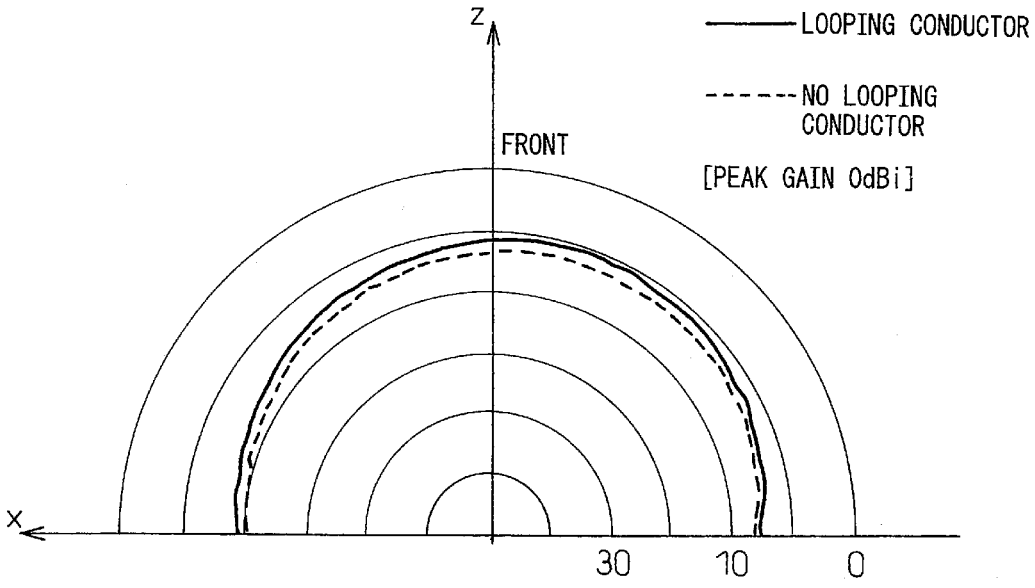

As explained above, by setting a GPS antenna 13 comprised of an antenna conductor 15, parasitic element 16, and feed terminals 17, 18 surrounded by a rectangular and looping line conductor 19 near the top end of the front windshield 1 of the automobile 60, as shown in FIG. 11, there will be an effect of an increase in gain of approximately 2 dB in comparison to a case with no looping line conductor 19.

Figure 2:
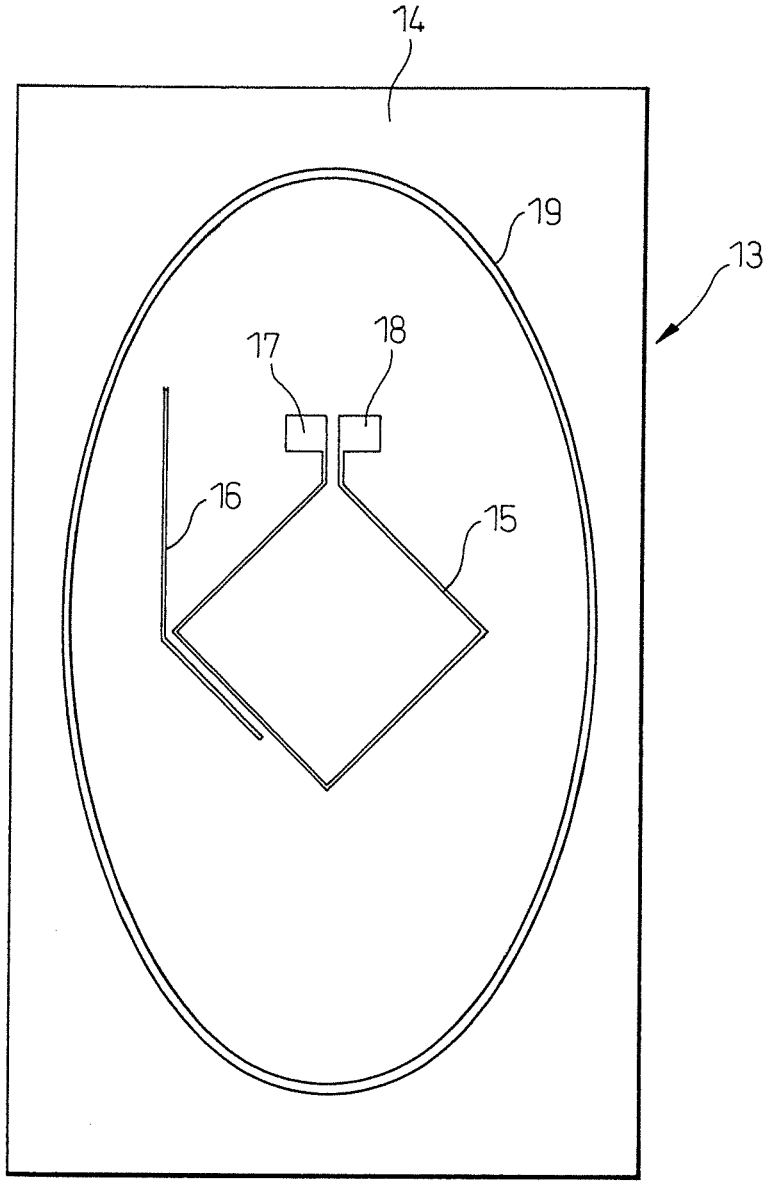
FIG. 2 is a plan view showing the structure of a circularly polarized wave reception antenna of a second embodiment of the present invention.

FIG. 2 shows the structure of a GPS antenna 13 of a second embodiment of the present invention. The GPS antenna 13 of this embodiment also uses a loop antenna comprised of a sheet-like transparent film 14 on which a rectangular antenna conductor 15 and a parasitic element 16 not electrically connected to the antenna conductor 15 are formed. There are feed terminals 17, 18 on the two ends of the antenna conductor 15. Connectors are connected to these feed terminals 17, 18. This is the same as in the first embodiment.

In the first embodiment, the antenna conductor 15, parasitic element 16, and feed terminals 17, 18 were surrounded by the rectangular looping line conductor 19. On the other hand, in the second embodiment, the antenna conductor 15, parasitic element 16, and feed terminals 17, 18 are surrounded by a vertically long elliptical looping line conductor 19. Here as well, making the total length of the looping line conductor 19 three times or so the total length (4Z) of the antenna conductor 15 will increase the gain of the GPS antenna 13. Further, in this case, the ratio (X:Y) of the length X of the minor axis of the elliptical line conductor 19 to the length Y of major axis is optimally 1:1, but there is an effect of raising the gain even in a range of 1:2 to 2:1.

Figure 3A:
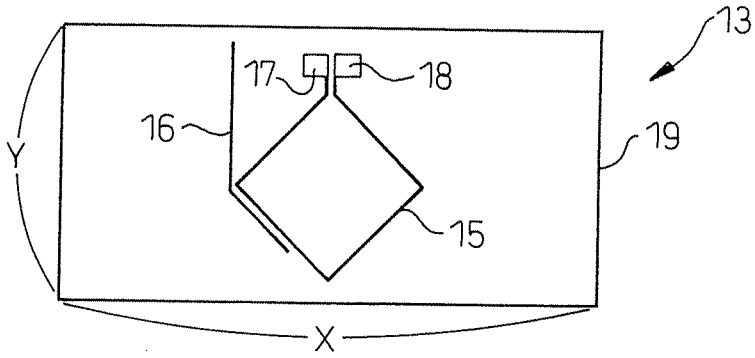
FIG. 3A is a view showing a modification of a circularly polarized wave reception antenna of the first embodiment shown in FIG. 1A wherein a looping line conductor with an exterior rectangular shape has a lateral direction length X much longer than a longitudinal direction length Y.
Figure 3B:
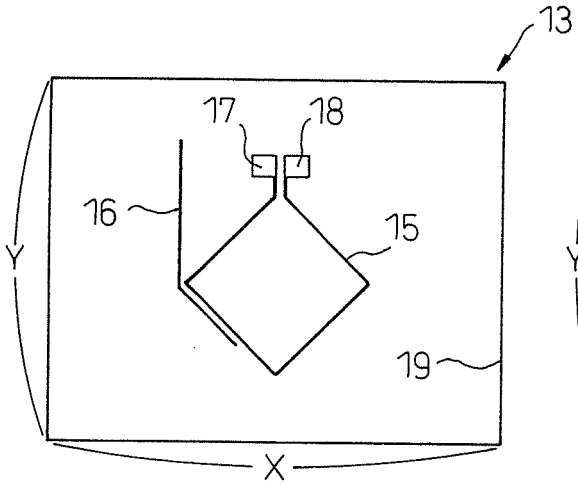
FIG. 3B is a view showing a modification of a circularly polarized wave reception antenna of the first embodiment shown in FIG. 1A wherein a looping line conductor with an exterior rectangular shape has a lateral direction length X slightly longer than a longitudinal direction length Y.
Figure 3C:
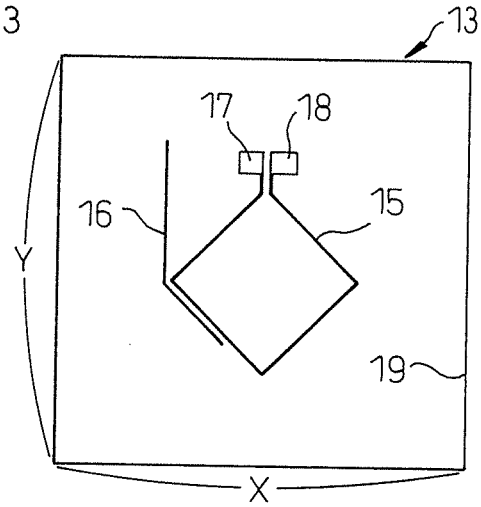
FIG. 3C is a view showing a modification of a circularly polarized wave reception antenna of the first embodiment shown in FIG. 1A wherein a looping line conductor with an exterior rectangular shape has a lateral direction length X nearly equal to a longitudinal direction length Y.
Figure 3D:
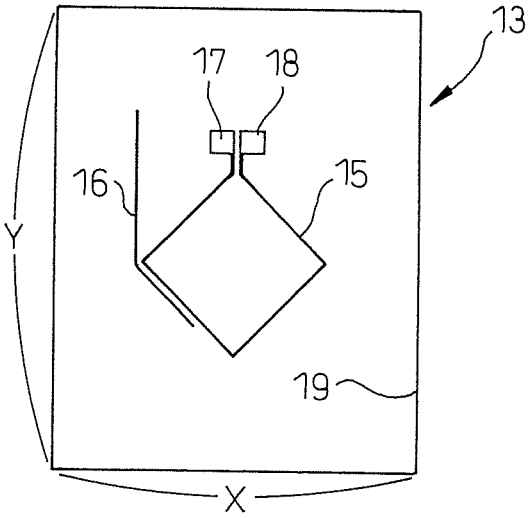
FIG. 3D is a view showing a modification of a circularly polarized wave reception antenna of the first embodiment shown in FIG. 1A wherein a looping line conductor with an exterior rectangular shape has a lateral direction length X slightly shorter than a longitudinal direction length Y.
Figure 3E:
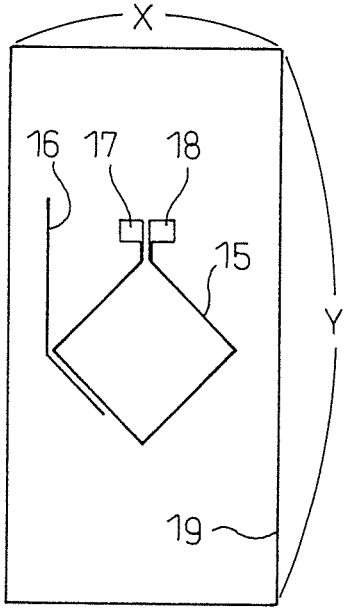
FIG. 3E is a view showing a modification of a circularly polarized wave reception antenna of the first embodiment shown in FIG. 1A wherein a looping line conductor with an exterior rectangular shape has a lateral direction length X much shorter than a longitudinal direction length Y.

Note that, the antenna 13 of the first embodiment, as shown in FIG. 3C, preferably has a ratio (X:Y) of the length X of the lateral direction of the looping line conductor 19 to the length Y of the longitudinal direction of 1:1 or so. However, even if changing the X:Y ratio, without changing the sum of the side X and side Y, by making the length of the side X longer and conversely making the length of the side Y shorter so as to obtain the antenna 13 in the state shown in FIG. 3B, the gain is greater than in an antenna 13 of a state without a looping line conductor 19. Similarly, even if changing the ratio of X:Y, without changing the sum of the side X and side Y, by making the length of the side X even longer and making the length of the side Y even shorter so as to obtain the antenna 13 (X:Y=2:1) in the state shown in FIG. 3A, the gain is greater than in an antenna 13 of a state without a looping line conductor 19. Further, even if changing the X:Y ratio, without changing the sum of the side X and side Y, by making the length of the side X shorter and making the length of the side Y longer so as to obtain the antenna 13 in the state shown in FIG. 3D or FIG. 3E, the gain is greater than in an antenna 13 of a state without a looping line conductor 19. Further, if making the X:Y ratio 1:2 like the antenna 13 in the state shown in FIG. 3E, the gain will be no different from the antenna 13 shown in FIG. 3A.

Figure 4A:
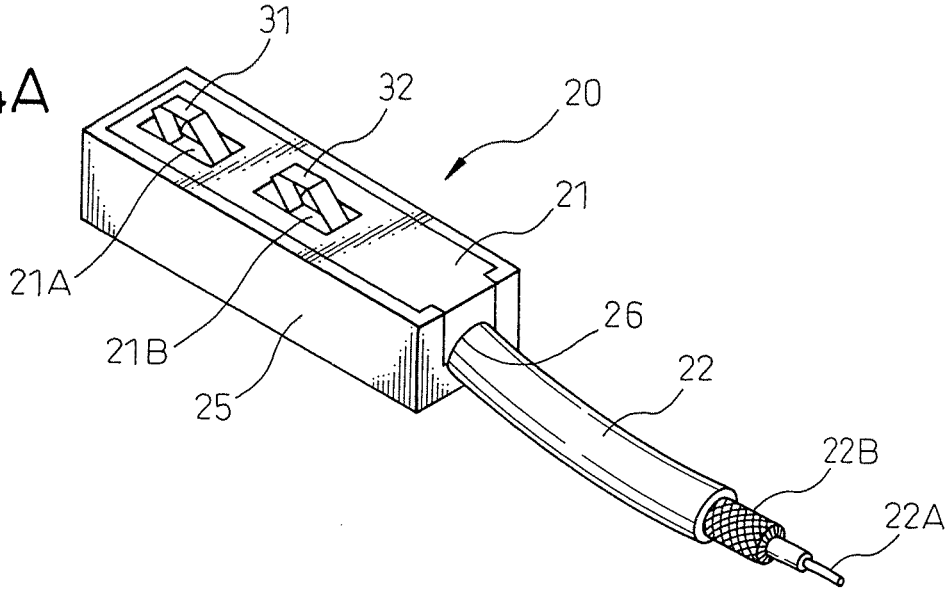
FIG. 4A is a perspective view showing the appearance of a connector and coaxial cable connected to a feed terminal of a loop antenna.
Figure 4B:
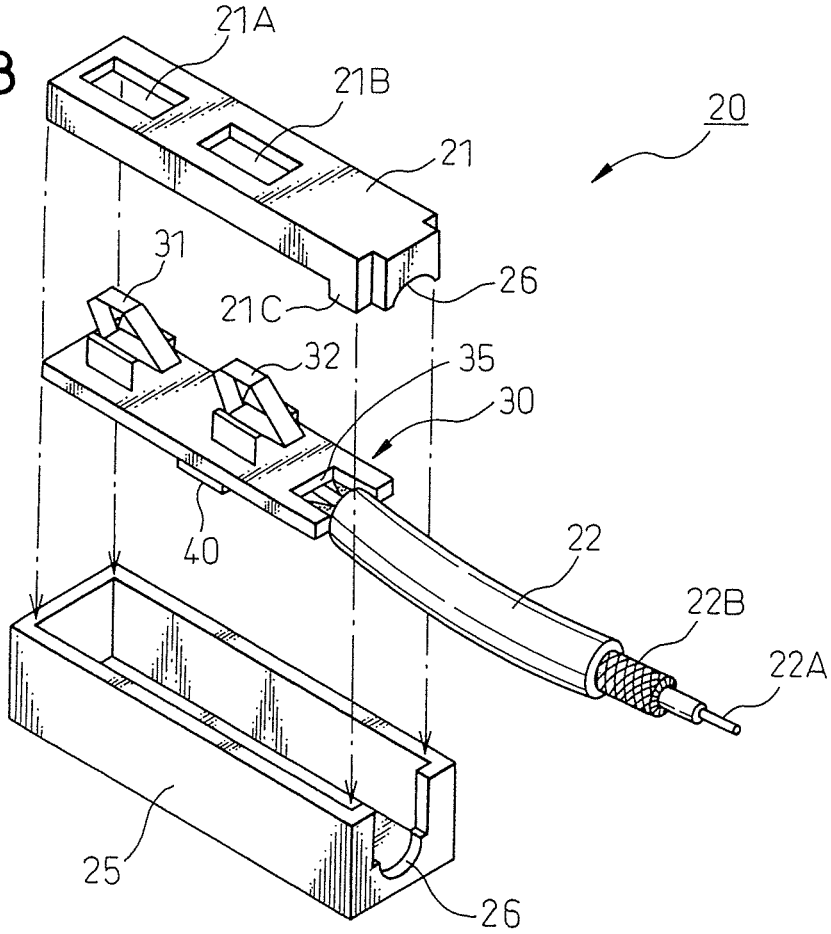
FIG. 4B is a disassembled perspective view of the connector shown in FIG. 4A.

FIGS. 4A and 4B show the appearance of the connector 20 shown in FIG. 1B and the connector 20 in a disassembled state. As shown in FIG. 4A, the connector 20 comprises a combination of an inner case 21 and outer case 25. The surface of the inner case 21 (the surface the antenna 10 is mounted to) has two openings 21A, 21B. Connection terminals 31, 32 having springiness protrude from these openings 21A, 21B. The connector 20 is fixed on top of each of the feed terminals 17, 18 with two-sided adhesive tape or other adhesive stuck on the surface of the inner case 21.

The connection terminals 31, 32, as shown in FIG. 4B, are mounted on one surface of the circuit board (dielectric board) 30 built in the inner case 21 and outer case 25. The circuit board 30 is connected to a coaxial cable 22. The other surface of the circuit board 30 is equipped with an integrated circuit 40 to be mentioned later. Generally, the connection terminal 31 is the hot side (signal transmission side) terminal, and the connection terminal 32 is the ground side terminal.

Figure 5A:
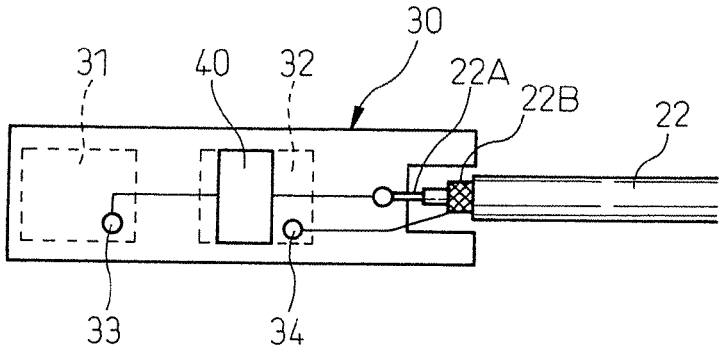
FIG. 5A is a view of an example of the circuit board shown in FIG. 4B seen from the bottom surface.

FIG. 5A shows the general structure of the circuit board 30 inside the connector 20 shown in FIG. 4B excluding the inner case 21 and outer case 25. Connection terminals 31, 32 are mounted on the bottom surface side of the circuit board 30 and are led to the top surface side of the circuit board 30 by the through holes 33, 34. In this example, the through hole 33 is connected to the input terminal of the integrated circuit 40 mounted on the top surface of the circuit board 30, and the through hole 34 is connected to the ground line (outside conductor) 22B of the coaxial cable 22. The integrated circuit 40 amplifies and otherwise processes the signals received by the antennas and outputs the processed signals to a center conductor (inner side conductor) 22A of the coaxial cable 22.

Figure 5B:
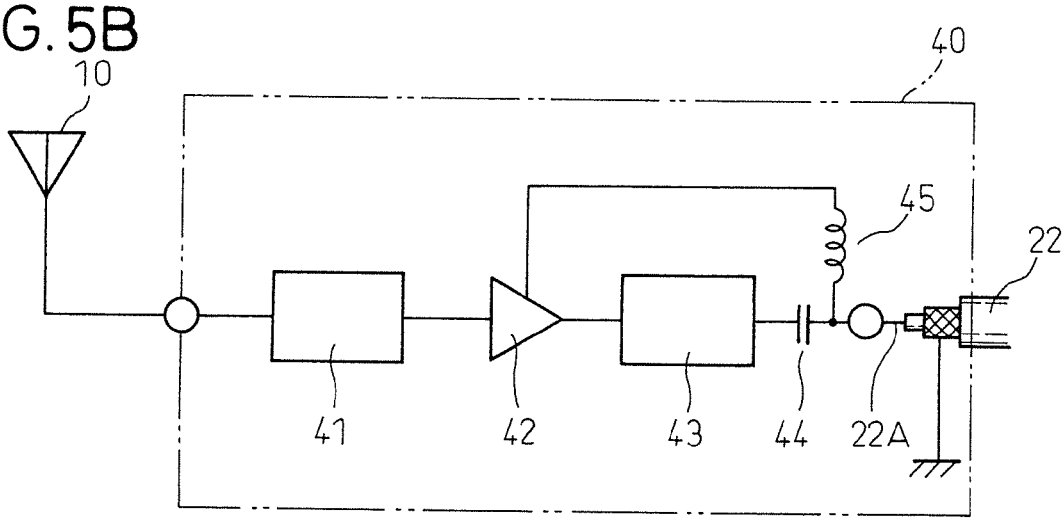
FIG. 5B is a block circuit diagram showing the internal structure of an amplifier mounted on the circuit board shown in FIG. 5A.

FIG. 5B shows the internal structure of the integrated circuit 40 shown in FIG. 5A. The integrated circuit 40 has inside it a filter 41 connected to the antenna 10, an amplifier 42 amplifying a signal output from the filter 41, and a filter 43 determining the signal band output from the amplifier 42. This filter 43 is connected to the center conductor 22A of the coaxial cable 22 through a capacitor 44 which blocks direct current. This coaxial cable 22 is a cable also supplying power. The power voltage (direct current) is supplied to the amplifier 42 through the coil 45 blocking the alternate current component.

Figure 5C:
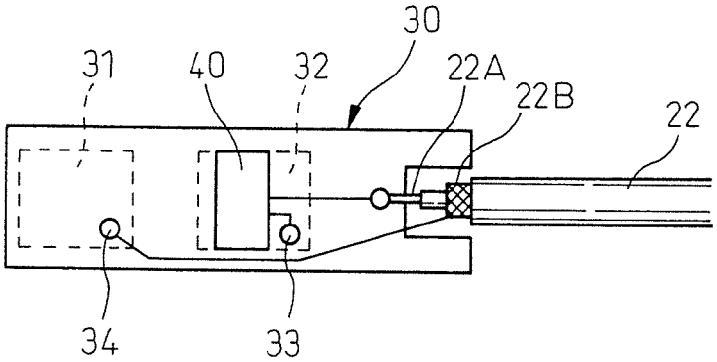
FIG. 5C is a view of another example of a circuit board shown in FIG. 4B seen from the bottom surface.

FIG. 5C shows the structure of a circuit board 30 different from the connector 20 shown in FIG. 5A excluding the inner case 21 and outer case 25. In the circuit board 30 of the connector 20 shown in FIG. 5A, the connection terminal 31 is the hot side (signal transmission side) terminal which is connected to the input terminal of the integrated circuit 40 through the through hole 33, and the connection terminal 32 is the ground side terminal which is connected to the ground line 22B of the coaxial cable 22 through the through hole 34. On the other hand, in the circuit board 30 of the connector 20 shown in FIG. 5C, the connection terminal 31 is the ground side terminal and is connected to the ground line 22B of the coaxial cable 22 through the through hole 34, and the connection terminal 32 is the hot side terminal and is connected to the input terminal of the integrated circuit 40 through the through hole 33. In this way, the connection terminal 31 may also be made the ground side terminal and the connection terminal 32 the hot side terminal.

In the first embodiment, it was found by experiments that the rectangular looping line conductor 19 surrounding the antenna conductor 15, parasitic element 16, and feed terminals 17, 18 is effective even if the conductor is not continuous across the entire circumference. Further, it was found that the rectangular looping line conductor 19 surrounding the feed terminals 17, 18 of the GPS antenna 13 had a total length close to the loop length of the loop antenna that the DTV antenna is comprised from. Thus, the inventors proposed cutting out a portion of the rectangular looping line conductor 19, forming the feed terminals 11, 12 at the cut-out ends shown in FIG. 6A, and making the rectangular looping line conductor 19 a DTV antenna 10A.

Figure 6A:
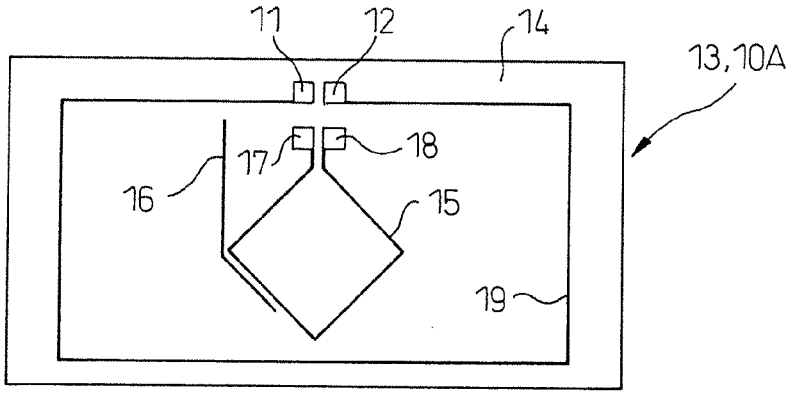
FIG. 6A is a plan view showing the structure of a modification of the antenna of the first embodiment of the present invention.
Figure 6B:
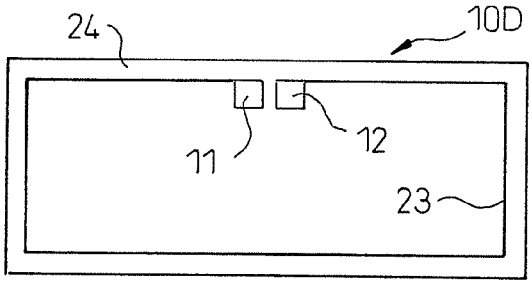
FIG. 6B is a plan view showing the general structure of a DTV reception antenna.
Figure 6C:
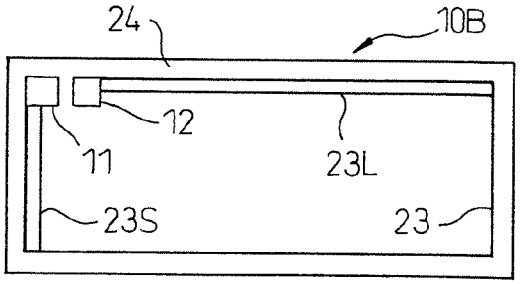
FIG. 6C is a plan view showing a different structure of a DTV reception antenna.
Figure 6D:
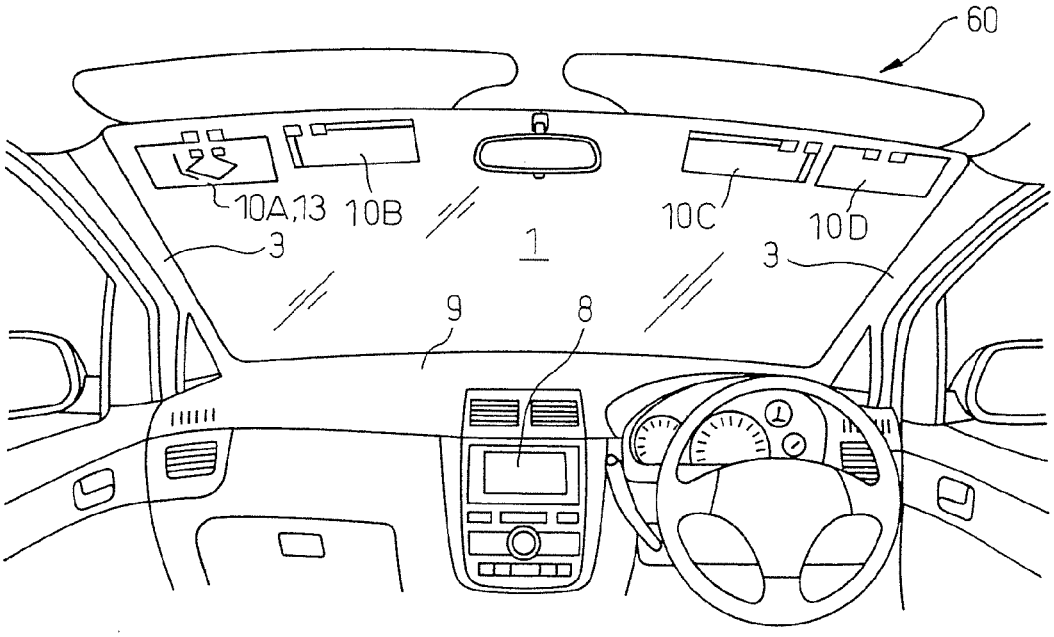
FIG. 6D is a perspective view of the front windshield of an automobile to which antennas etc. shown from FIG. 6A to FIG. 6C are attached and the surroundings of the same seen from the vehicle interior.

In this case, an integrated antenna 10A, 13 in which the GPS antenna 13 and DTV antenna 10A are combined as shown in FIG. 6A is positioned at the top left corner of the front windshield 1 of the automobile 60. In addition, the DTV antenna 10D shown in FIG. 6B, the DTV antenna (with feed terminals 11, 12 offset to one side) 10B shown in FIG. 10C, and the DTV antenna 10C which is a mirror image of the DTV antenna 10D shown in FIG. 10C can be arranged in a line from the integrated antenna 10A, 13 on the top end of the front windshield 1 of the automobile 60 as shown in FIG. 6D to form an antenna system. Note that, in the antenna system shown in FIG. 6D, the feed terminals of the antennas are connected to connectors so depiction of the feed circuits comprised of the connectors and coaxial cables is omitted.

Figure 7:
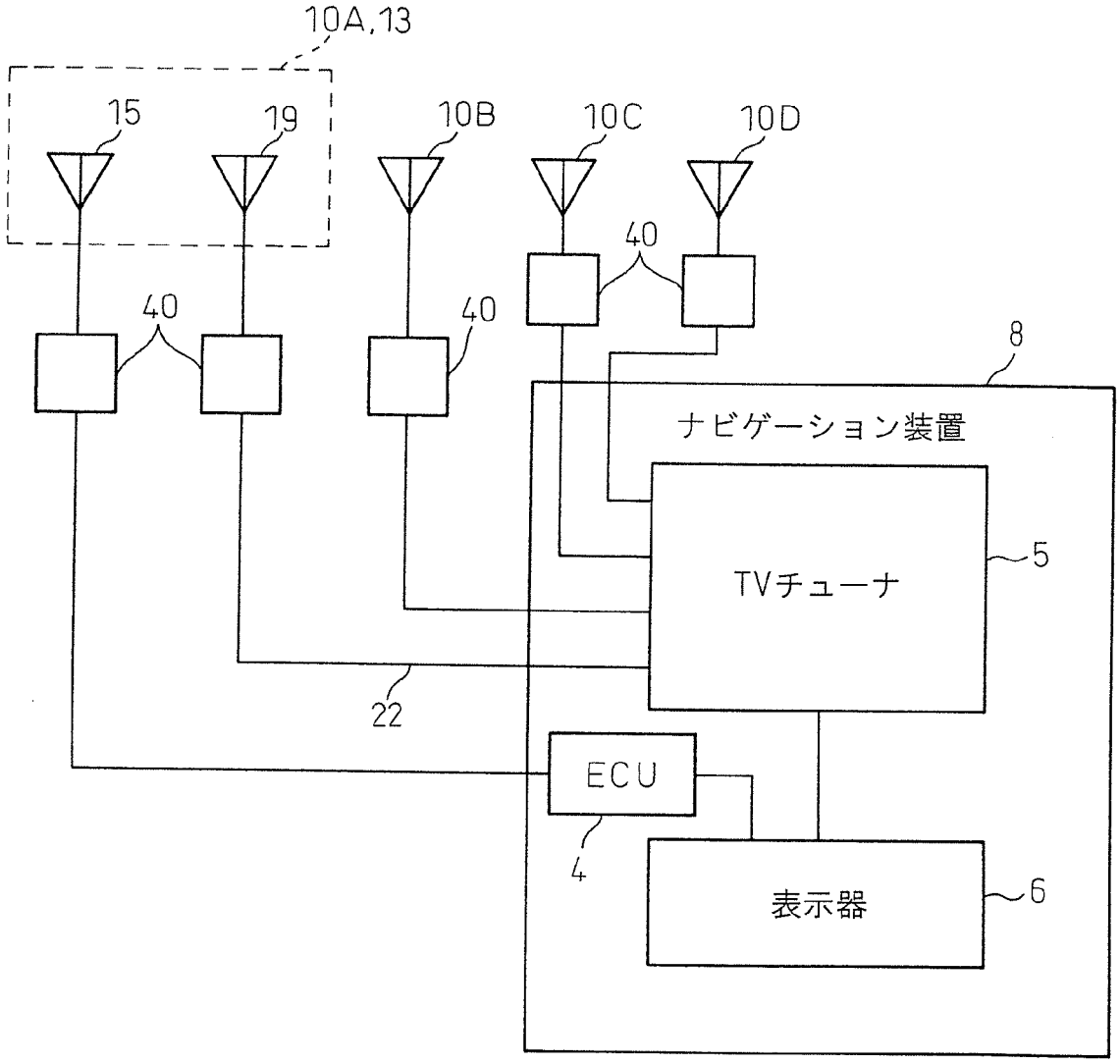
FIG. 7 is a circuit diagram showing the connection of the antenna shown in FIG. 6D to a navigation system mounted in a vehicle.

FIG. 7 is a circuit diagram showing the connection of the antenna system comprised of the antennas 10A, 13, 10B, 10C, 10D of FIG. 6D to the navigation system 8 mounted in a vehicle. In this embodiment, there is a built-in TV tuner 5 in the navigation system 8, however, the TV tuner 5 may also be separate from the navigation system 8.

In this embodiment, the antenna conductor 19 in the integrated antenna 10A, 13 and the film antennas 10B, 10C, and 10D are DTV antennas, and the antenna conductor 15 in the integrated antenna 10A, 13 is a GPS antenna. The DTV signals received by these film antennas 10A, 10B, 10C, and 10D are guided to the TV tuner 5 with cables 22 through integrated circuits 40 that are built inside the connectors and perform amplification and the like. A demodulated image is displayed in the display 6 when the navigation system 8 is in the TV mode. Further, the GPS signals received by the GPS antenna 13 (antenna conductor 15) mounted in the film antenna 10AM are guided through an integrated circuit 40 and cable 22 to the ECU 4 of the navigation system 8 where the current location of the automobile is detected and displayed on the display 6 of the navigation system 8 together with map information.

Figure 8A:
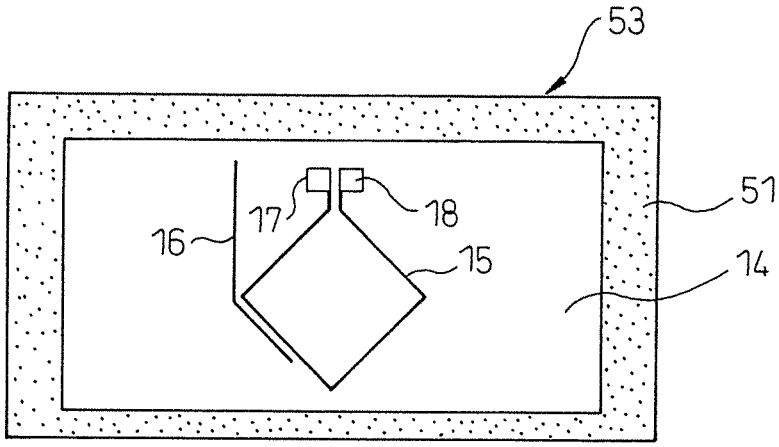
FIG. 8A is a plan view showing the structure of a circularly polarized wave reception antenna of a third embodiment of the present invention.

FIG. 8A shows the structure of the antenna 53 of a third embodiment of the present invention. The GPS antenna 13 of the third embodiment also uses a loop antenna comprised of a sheet-like transparent film 14 on which a rectangular antenna conductor 15 and a parasitic element 16 not electrically connected to the antenna conductor 15 are formed. It can receive a circularly polarized wave from a GPS satellite and, further, send a circularly polarized wave. On the other hand, there are feed terminals 17, 18 at the two ends of the antenna conductor 15. Later explained connectors are connected to these feed terminals 17, 18. The antenna conductor 15, parasitic element 16, and feed terminals 17, 18 are formed by conductive ink or copper foil or another conductor on a sheet-like transparent film 14 in the same way as the first embodiment.

In the GPS antenna 53 of the third embodiment, a metal sheet 51 having an opening of the same dimensions as the rectangular looping line conductor 19 explained by the first embodiment is attached on the transparent film 14 around the antenna conductor 15, parasitic element 16, and feed terminals 17, 18. In the third embodiment, so long as the dimensions of the opening of the metal sheet 51 are the same, the size of the metal sheet 51 is not particularly limited. For example, when the length Z of one side of the rectangular antenna conductor 15 of the GPS antenna 13 is 32 mm or so, the length of the lateral direction of the opening of the metal plate 51 may be 95 mm or so and the length of the longitudinal direction 95 mm or so.

Figure 8B:
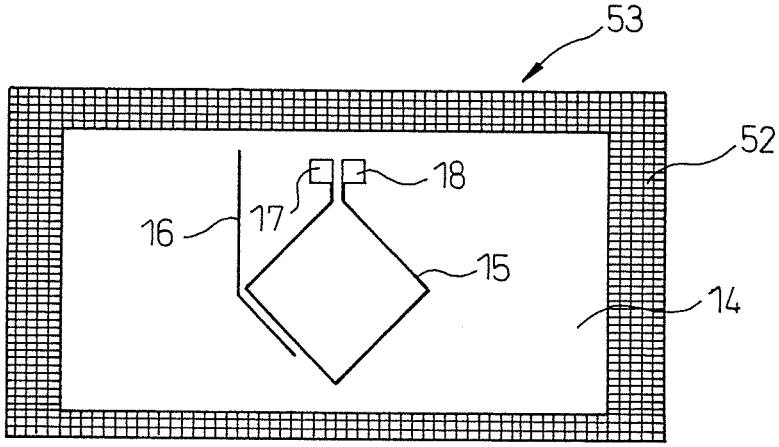
FIG. 8B is a plan view showing the structure of a modification of the antenna of the third embodiment of the present invention.

FIG. 8B shows a modification of the antenna 53 of the third embodiment of the present invention. The only difference between the antenna 53 of this modification and the antenna 53 of the third embodiment explained in FIG. 8A is that instead of the metal sheet 51, a metal mesh 52 is attached to the sheet-like transparent film 14. The performance of the antenna 53 of this modification is not much different from that of the antenna 53 of the third embodiment.

Figure 9A:
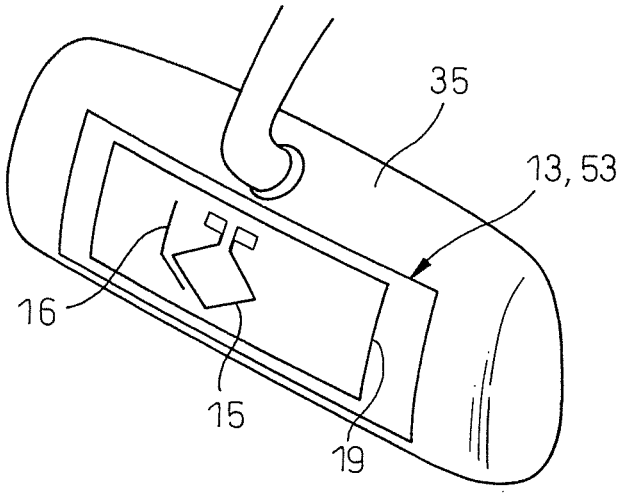
FIG. 9A is a perspective view showing an example of use attaching the antenna of the first embodiment of the present invention on the back mirror of an automobile.
Figure 9B:
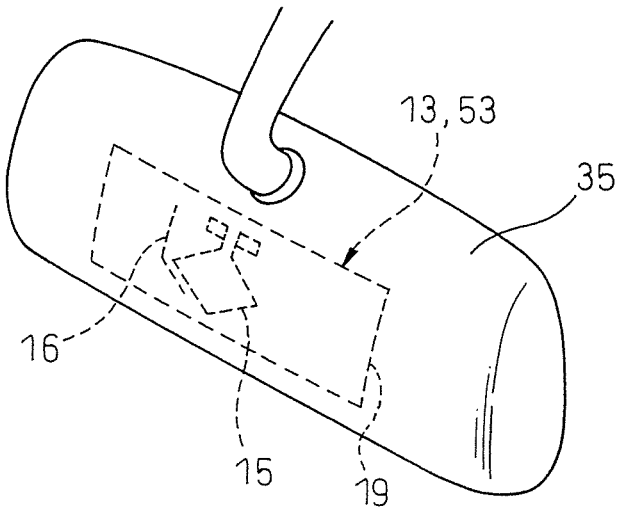
FIG. 9B is a perspective view showing an example of use burying the antenna of the first embodiment of the present invention in the back mirror of an automobile.

FIG. 9A shows an example of usee where the antenna 13, 53 of the first or third embodiment of the present invention is attached to the back mirror (inner rearview mirror 35) of an automobile. Further, FIG. 9B shows an example of use where the antenna 13, 53 of the first or third embodiment of the present invention is buried in the back mirror 35 of the automobile. By mounting the antenna 13, 53 of the present invention at this position, it can efficiently receive radio waves arriving from the upper front of the automobile.

Figure 10A:
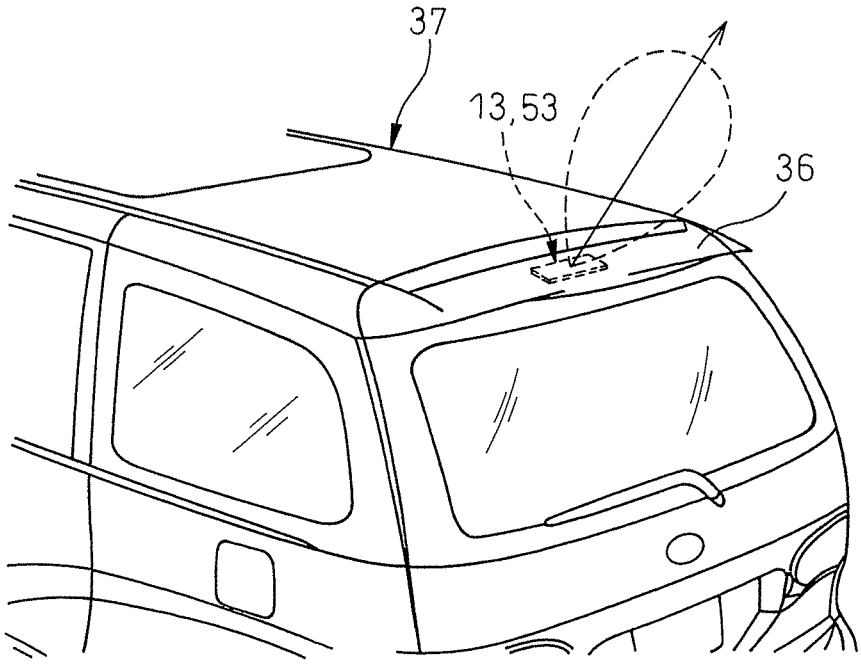
FIG. 10A is a perspective view showing an example of use incorporating the antenna of the present invention inside the rear spoiler of an automobile.
Figure 10B:
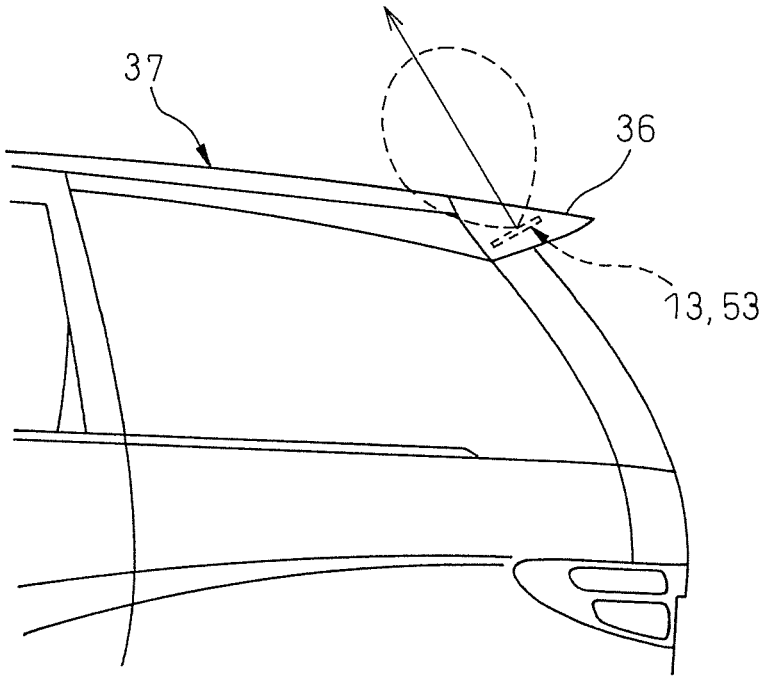
FIG. 10B is a lateral view showing an example of use incorporating the antenna of the present invention in the rear spoiler of an automobile.

FIGS. 10A and 10B show, as different examples of vehicle positions to mount the antenna 13, 53 of the present invention, examples where the antenna 13, 53 is built inside the rear spoiler 36 of a wagon type automobile 37. The directivity of the antenna 13, 53 at this position can be changed by the mounting angle of the antenna 13, 53 built inside the rear spoiler 36. As shown in FIG. 10A, by having the antenna 13, 53 built into the rear spoiler 37 tilted to the back direction, the directivity of the antennas 13, 53 is to the upper rear of the automobile 37. Further, as shown in FIG. 10B, by having the antenna 13, 53 built into the rear spoiler 36 tilted to the front, the directivity of the antennas 13, 53 is to the upper front of the automobile 37.

The antennas 13, 53 of the present invention can be mounted at positions other than these mounting positions, for example, a plastic rooftop etc. of the vehicle. The shape of the antenna conductor of the GPS antenna 13 that can be used in the antennas 13, 53 of the present invention and the numbers and arrangements of the parasitic elements 16 are not limited to these embodiments.

The invention claimed is:

1. A circularly polarized wave reception antenna comprising:

a loop antenna having two feed terminals;

a parasitic element positioned near and outside the loop antenna and comprised of a conductor independent of an antenna conductor of the loop antenna; and a closed loop conductor having no feed terminal positioned to surround a vicinity of the loop antenna and the parasitic element, and positioned to increase a gain of the loop antenna having the two feed terminals, wherein the loop antenna, the parasitic element, and the closed loop conductor are formed in a same plane, and wherein the total circumference of the closed loop conductor is 2.7 to 3.3 times the total circumference of the loop antenna, the closed loop conductor is rectangular, and a ratio of two adjacent sides of the rectangular closed loop conductor is in a range of 1:2 to 2:1.

2. The antenna as set forth in claim 1, wherein the closed loop conductor is a line loop conductor.

3. The antenna as set forth in claim 1, wherein the closed loop conductor is a metal sheet, and the loop antenna and the parasitic element are positioned inside an opening in the metal sheet.

4. The antenna as set forth in claim 1, wherein the loop antenna, the parasitic element, and the closed loop conductor are formed on top of a sheet-like dielectric body.

5. The antenna as set forth in claim 4, wherein the sheet-like dielectric body is a transparent film.

6. The antenna as set forth in claim 1, wherein the parasitic element includes a parallel part parallel to the loop antenna and a distant element distant from the loop antenna, and the closed loop conductor includes a part parallel to the distant element.

7. A circularly polarized wave reception antenna comprising:

a loop antenna having two feed terminals;

a parasitic element positioned near and outside the loop antenna and comprised of a conductor independent of an antenna conductor of the loop antenna; and a closed loop conductor having no feed terminal positioned to surround a vicinity of the loop antenna and the parasitic element, and positioned to increase a gain of the loop antenna having the two feed terminals, wherein the loop antenna, the parasitic element, and the closed loop conductor are formed in a same plane, and wherein the total circumference of the closed loop conductor is 2.7 to 3.3 times the total circumference of the loop antenna, the closed loop conductor is an ellipse, and a ratio of a major axis and a minor axis of the ellipse is in a range of 1:1 to 2:1.

8. The antenna as set forth in claim 7, wherein the closed loop conductor is a line loop conductor.

9. The antenna as set forth in claim 7, wherein the closed loop conductor is a metal sheet, and the loop antenna and the parasitic element are positioned inside an opening in the metal sheet.

10. The antenna as set forth in claim 7, wherein the loop antenna, the parasitic element, and the closed loop conductor are formed on top of a sheet-like dielectric body.

11. The antenna as set forth in claim 10, wherein the sheet-like dielectric body is a transparent film.

12. The antenna as set forth in claim 1, wherein the loop antenna, the parasitic element, and the closed loop conductor are formed on top of a transparent film, and the transparent film is attached to a top end of a front window of an automobile.

13. The antenna as set forth in claim 1, wherein the loop antenna, the parasitic element, and the closed loop conductor are formed on top of a sheet-like dielectric body, and the dielectric body is attached to a surface opposite to a mirror of a back mirror of an automobile.

14. The antenna as set forth in claim 1, wherein the loop antenna, the parasitic element, and the closed loop conductor are embedded in a surface opposite to a mirror of a back mirror of an automobile.

15. The antenna as set forth in claim 1, wherein the loop antenna, the parasitic element, and the closed loop conductor are embedded in a rear spoiler of an automobile.

16. The antenna as set forth in claim 7, wherein the loop antenna, the parasitic element, and the closed loop conductor are formed on top of a transparent film, and the transparent film is attached to a top end of a front window of an automobile.

17. The antenna as set forth in claim 7, wherein the loop antenna, the parasitic element, and the closed loop conductor are fowled on top of a sheet-like dielectric body, and the dielectric body is attached to a surface opposite to a mirror of a back mirror of an automobile.

18. The antenna as set forth in claim 7, wherein the loop antenna, the parasitic element, and the closed loop conductor are embedded in a surface opposite to a mirror of a back mirror of an automobile.

19. The antenna as set forth in claim 7, wherein the loop antenna, the parasitic element, and the closed loop conductor are embedded in a rear spoiler of an automobile.

* * * * *

UNITED STATES PATENT AND TRADEMARK OFFICE

CERTIFICATE OF CORRECTION

PATENT NO. : 8,994,598 B2
APPLICATION NO. : 12/739130
DATED : March 31, 2015
INVENTOR(S) : Kazushige Ogino et al.

It is certified that error appears in the above-identified patent and that said Letters Patent is hereby corrected as shown below:

In the Drawings:

| | |
|---|---|
| Sheet 7 of 11, FIG. 7, Refs. 5 & 6 | Delete Drawing Sheet 7 and substitute therefore the Drawing Sheet, consisting of FIG. 7, as shown on the attached page |
| Sheet 11 of 11, FIG. 11 | Delete Drawing Sheet 11 and substitute therefore the Drawing Sheet, consisting of FIG. 11, as shown on the attached page |

In the Claims:

| | |
|---|---|
| Col. 9, line 11, Claim 17 | Delete "fowled",<br>Insert --formed-- |

Signed and Sealed this
Nineteenth Day of January, 2016

Michelle K. Lee

Michelle K. Lee
*Director of the United States Patent and Trademark Office*